US005620058A

United States Patent [19]

Forrester

[11] Patent Number: 5,620,058

[45] Date of Patent: Apr. 15, 1997

[54] EMERGENCY EVACUATION SYSTEM

[75] Inventor: David J. Forrester, Jacksonville, Ala.

[73] Assignee: Cerberus Institute for Research and Development, Inc., Warner Robins, Ga.; a part interest

[21] Appl. No.: 416,367

[22] Filed: Apr. 4, 1995

[51] Int. Cl.[6] ..... A62B 3/00

[52] U.S. Cl. ..... 182/48; 187/239; 187/414

[58] Field of Search ..... 187/239, 241, 187/242, 414; 182/48; 193/25 B, 32, 40

[56] References Cited

U.S. PATENT DOCUMENTS

| | | | |
|---|---|---|---|
| 715,960 | 12/1902 | Dedrick . | |
| 2,955,299 | 10/1960 | Ingram . | |
| 3,433,323 | 3/1969 | Ukawa . | |
| 3,554,344 | 1/1971 | Summer et al. . | |
| 3,819,011 | 6/1974 | Kinase et al. . | |
| 3,840,057 | 10/1974 | Lesh, Jr. | 182/48 X |
| 3,968,856 | 7/1976 | Keen et al. | 182/48 |
| 4,037,685 | 7/1977 | Talucci . | |
| 4,162,717 | 7/1979 | Orii et al. | 182/48 |
| 4,167,224 | 9/1979 | Kinase et al. | 182/48 |
| 4,240,520 | 12/1980 | LaGrone et al. | 182/48 |
| 4,830,141 | 5/1989 | Montaigne . | |
| 5,150,765 | 9/1992 | Chen . | |

FOREIGN PATENT DOCUMENTS

| | | |
|---|---|---|
| 3504153 | 8/1986 | Germany . |
| 53-67999 | 7/1978 | Japan . |
| 1540834 | 2/1990 | U.S.S.R. . |
| 2060778 | 5/1981 | United Kingdom . |

*Primary Examiner*—William E. Terrell
*Assistant Examiner*—Khoi H. Tran
*Attorney, Agent, or Firm*—James Creighton Wray

[57] ABSTRACT

An emergency evacuation system uses three primary concepts—Retarded Free Fall, Temporary Structures and Energetics—to provide for rapid, safe rescue. An inflatable descent tube with entry ports is installed along the side of a structure or at the top of an elevator shaft. In emergency situations, a gas generator connected to the tube is activated and inflates the tube with gas. The interior surface of the tube includes energy absorption structures strategically positioned to retard the rate of fall. The structures absorb energy from falling bodies and translate some of the vertical force to horizontal force as the evacuee is temporarily deflected sideways in the tube. Friction strands cover the surfaces of the structures to further reduce velocities of falling evacuees. An inflatable exit ramp is positioned at the bottom of the tube to cushion the fall of the evacuee and lead the evacuee to safety. Back up systems, including rings of high pressure water nozzles, are installed in the tube to interrupt the evacuee's acceleration in situations where the internal structures fail. The system can be installed as one unit or broken down into multiple tube segments. The number and position of entry ports are variable, depending on the situational requirements of the structure to which the system is attached. The present invention has many configurations including fixed internal and external installations, ground and air mobile rescue units, and similar configurations for maritime applications.

43 Claims, 12 Drawing Sheets

FIG. 1
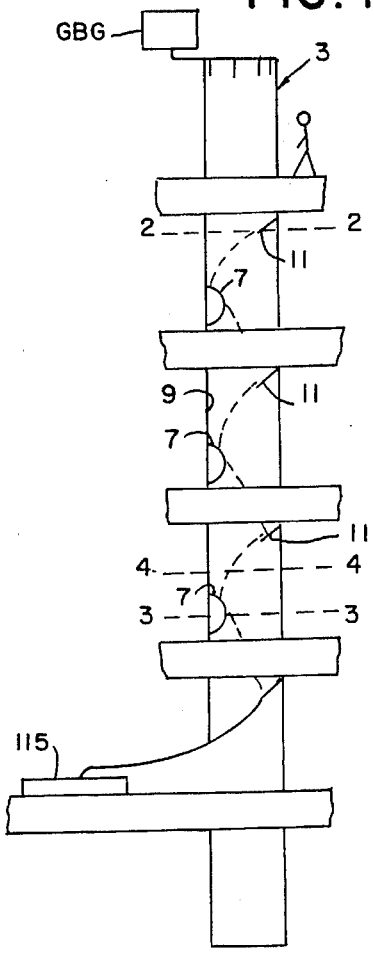
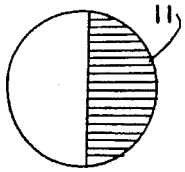
FIG. 2
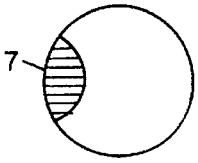
FIG. 3
FIG. 4
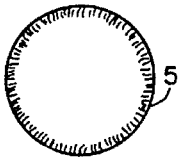
FIG. 5
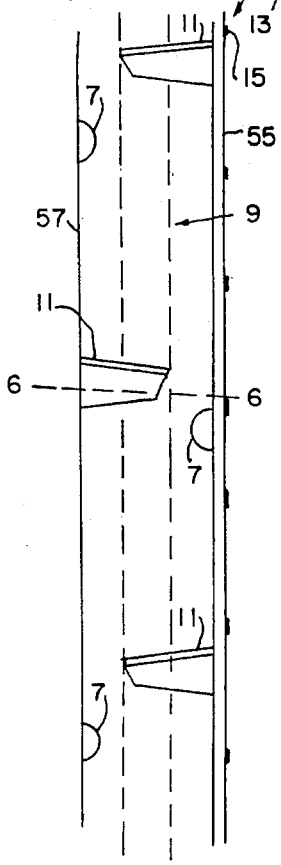
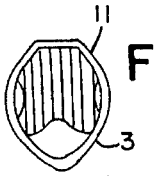
FIG. 6
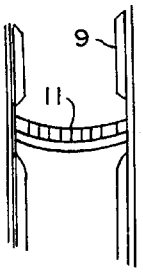
FIG. 7
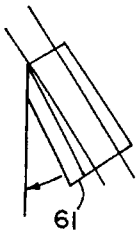
FIG. 11
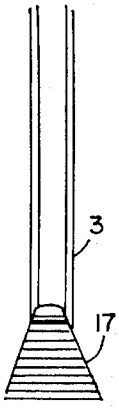
FIG. 12
FIG. 9
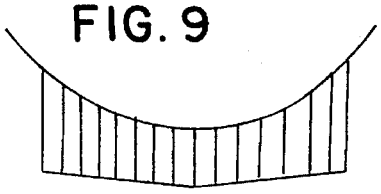
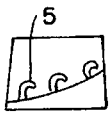
FIG. 10
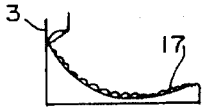
FIG. 13
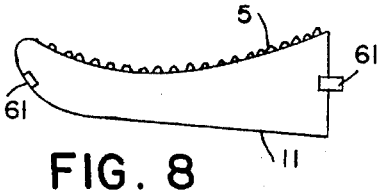
FIG. 8

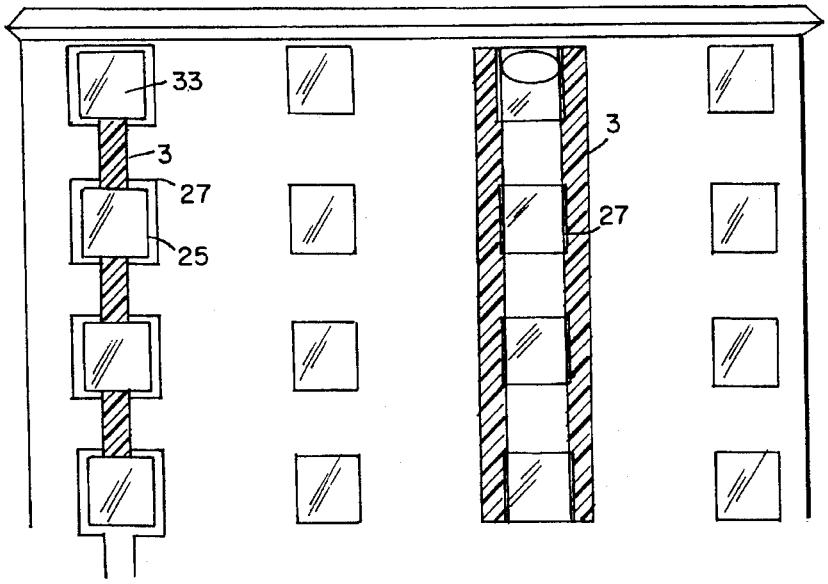
FIG. 16
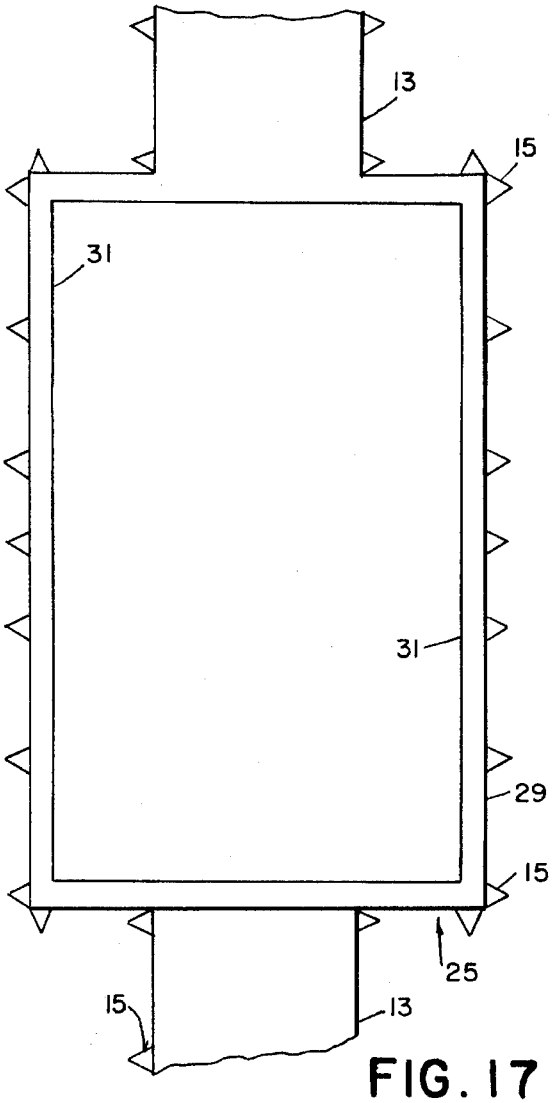
FIG. 17
FIG. 18a
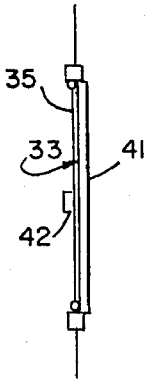
FIG. 18b
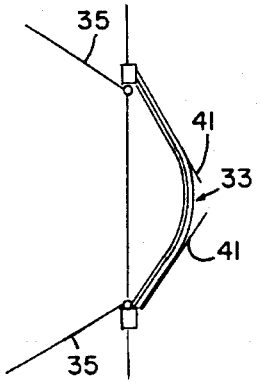
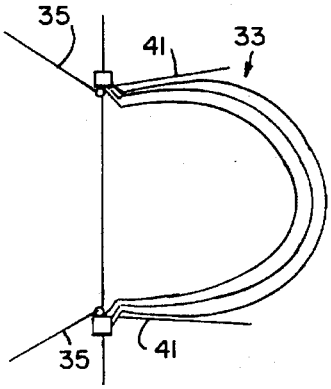
FIG. 18c

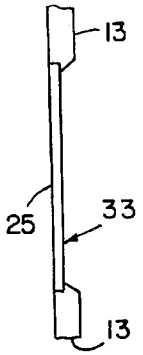
FIG. 19a
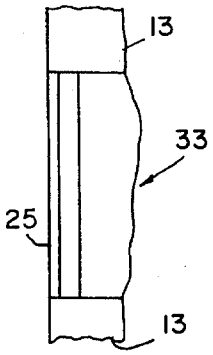
FIG. 19b
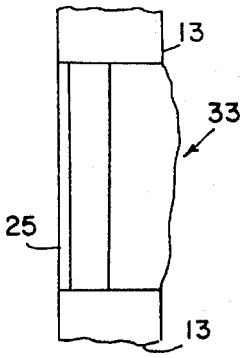
FIG. 19c
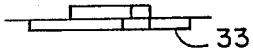
FIG. 20a
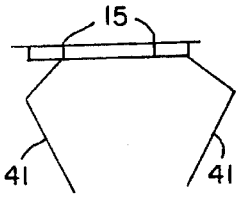
FIG. 20b
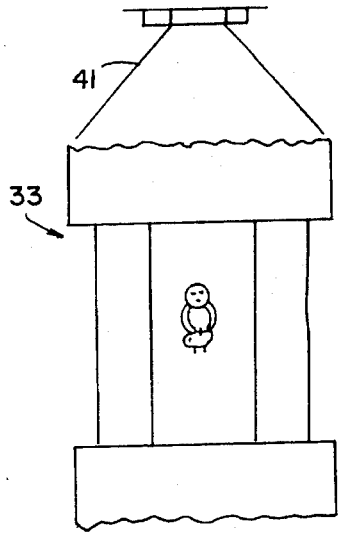
FIG. 20c
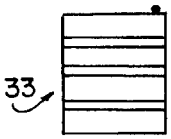
FIG. 21
FIG. 22b
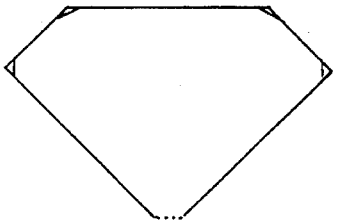
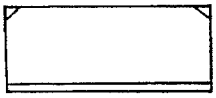
FIG. 22a
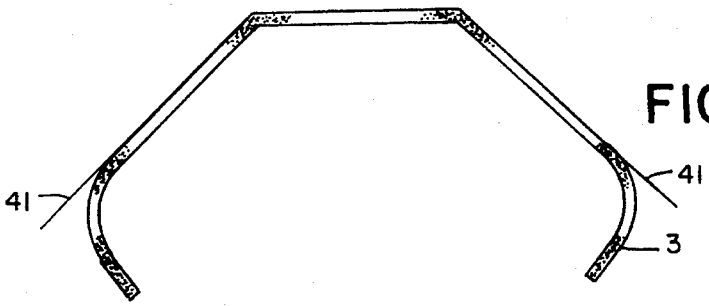
FIG. 22c FIG. 23a
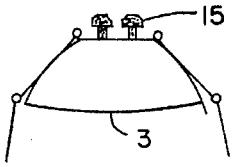
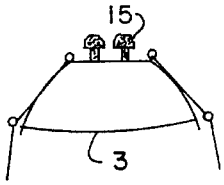
FIG. 23b
FIG. 23c
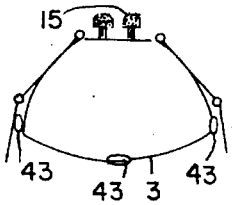
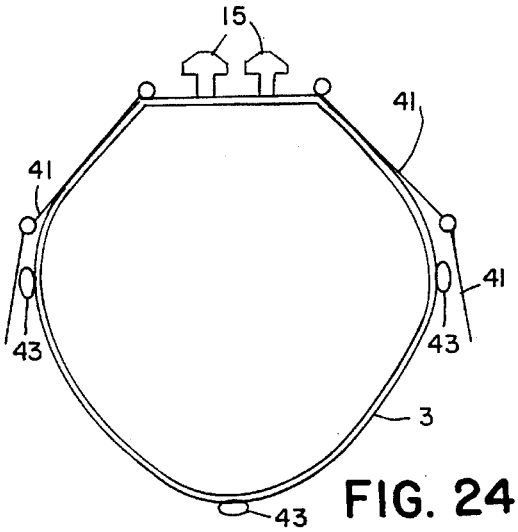
FIG. 24
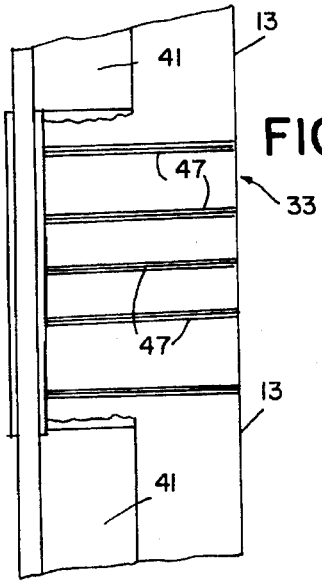
FIG. 25
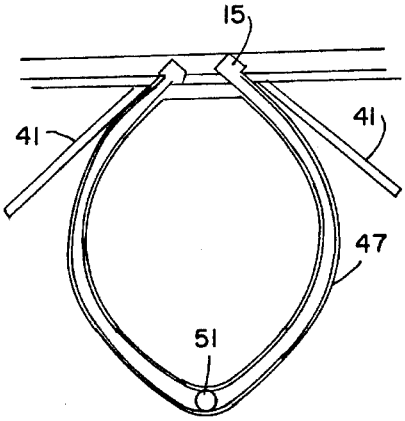
FIG. 27
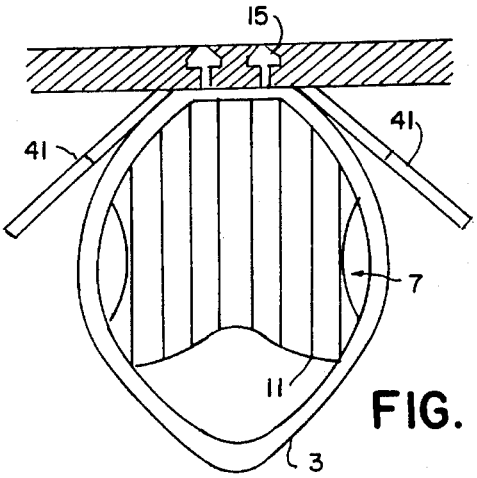
FIG. 28
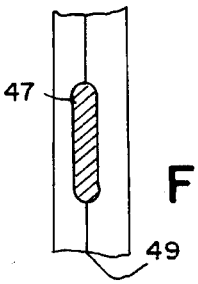
FIG. 26

FIG. 29a
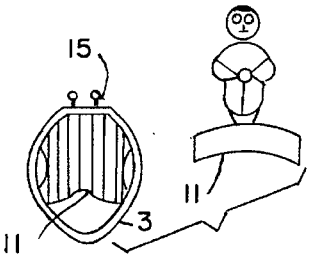
FIG. 29b
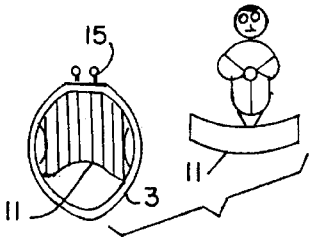
FIG. 29c
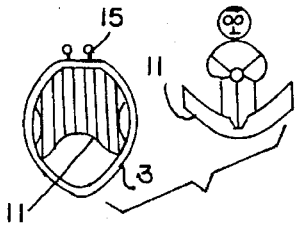
FIG. 29d
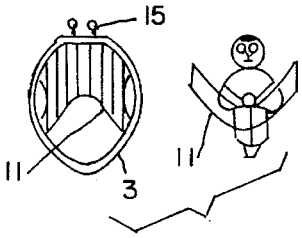
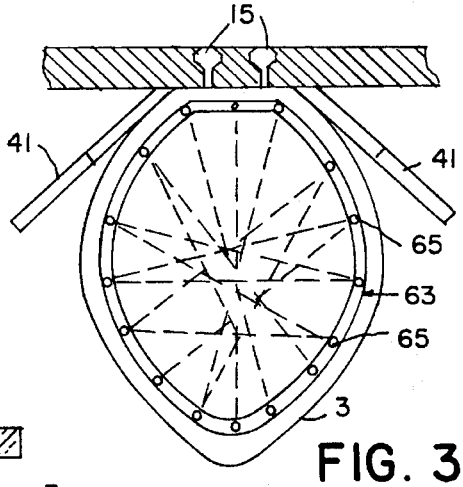
FIG. 30
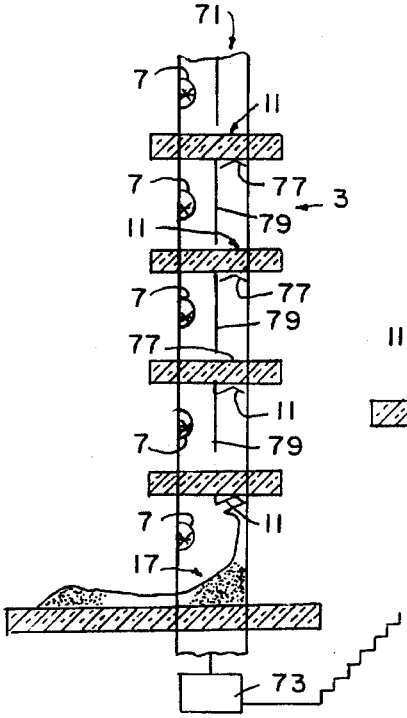
FIG. 31
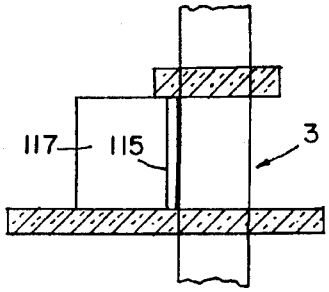
FIG. 32
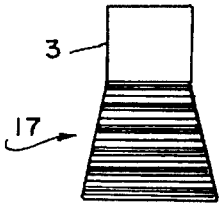
FIG. 33

READ BEFORE ENTRY

WRITTEN AND ORAL INSTRUCTIONS

* REMOVE SHOES
* DO NOT HAND CARRY OBJECTS
* STEP TO ENTRY PORT
* GRAB OVERHEAD SWING BAR
* STEP FORWARD AND RELEASE BAR
* DROP WITH HANDS AT SIDE AND WITH LEGS TOGETHER
* UPON LANDING DO NOT STAND
* CRAWL TO EDGE OF SLIDE FOLLOWING ORANGE LINE TO OUTSIDE
* IF HEAR WARNING COUNT TO FIVE BEFORE STEPPING IN TUBE

CHILDREN:

* CHILDREN 10 POUNDS AND ABOVE SHOULD DROP INDEPENDENTLY
* SMALL CHILDREN SHOULD BE GRASPED TO CHEST OF DROPPING ADULT

FIG. 62

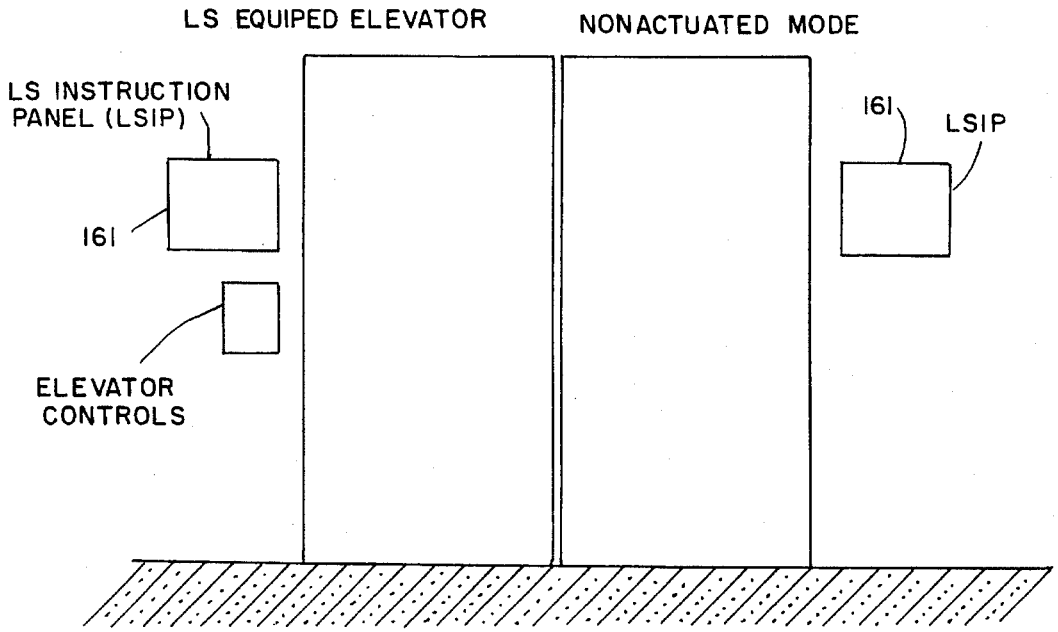

FIG. 63

EMERGENCY EVACUATION SYSTEM

BACKGROUND OF THE INVENTION

This invention relates to emergency evacuation systems for buildings, ships and other fixed and movable structures.

Individuals routinely work and live at elevations that do not permit safe free-fall drops in emergency situations. Ladders are often unavailable or inadequate in height. Jumping from a window or from a roof is many times the only tenable option. In practical terms, any fall in excess of five meters creates a grave probability of injury or death. Alternative evacuation plans for individuals, such as helicopter evacuations from roof tops, are time consuming, dangerous and often impossible due to fire, explosions, surrounding structures and weather.

Emergencies, such as fires, often limit escape options. The chaos and mass confusion that accompany emergencies increase evacuation times and delay rescues. Descending stairs in fire exits becomes a dangerous experience, as excessive numbers of excited people crowd into the exits, pushing and tripping one another in attempting to reach safety. Heat and toxic gases further complicate evacuations. Needs exist for evacuation systems that provide quick and easy escape routes.

Recent emergencies across the United States have demonstrated the need for quicker evacuation systems. During the bombing of the World Trade Center in New York, it took rescue workers over five hours to evacuate the buildings. While there was smoke and no power, other emergency conditions were ideal. There was no fire and no continuing threat. The buildings had strong structural integrity. Highly trained and well-equipped emergency services and personnel were readily available. Under non-ideal circumstances with fire, smoke and a continuing threat, a five hour evacuation would have inevitably resulted in a massive loss of life.

Needs exist for evacuation systems that, regardless of the circumstances, can evacuate structures proportional in size to the World Trade Center in a substantially shorter time than existing systems.

New evacuation systems must be compatible with existing structures. Installation of new evacuation systems must be economically feasible and must not require extensive modifications in the framework of the existing structures. Additionally, safety apparatus cannot interfere with other functional aspects of the building, and should not, when inactive, destroy the artistic integrity of the structure.

Existing emergency descent systems are inadequate. Most systems use permanently fixed structures and rely on springs and hydraulics to reduce an evacuee's rate of descent. Needs exist for evacuation systems that are simple, inexpensive, and mobile.

SUMMARY OF THE INVENTION

An emergency evacuation system disclosed herein is useful for fixed and mobile structures. The present invention has several different configurations including fixed and/or mobile internal or external installations, ground and air erected mobile rescue units, and configurations for maritime applications. Advantages of the present system include reduced cost relative to other evacuation methods, time and weather independence, minimal risk, high speed evacuation potential, and easy installation without interfering with the primary use of existing structures.

The present invention involves three primary concepts: Retarded Free Fall, Temporary Structures and Energetics.

Retarded Free Fall (RFF) is a core concept of the present system. The easiest and quickest way to get down from a height is to jump. Unfortunately, when a typical adult human jumps from a building, the individual falls with a terminal velocity of approximately 160 feet per second, depending on mass and surface area. Sudden deceleration from that velocity is undesirable. The old adage that "it is not the fall that kills you but rather the sudden stop" is hard to refute. RFF is a technique that allows for extended free fall without substantial risk of injury to evacuees by slowing or retarding the acceleration of evacuees.

Generally, there are only two techniques for slowing or countering the acceleration of a falling body: upward thrust, such as that provided by retro rockets, and increasing the surface area of the body, such as by attaching to the body a parachute. The present invention uses the principles of energy absorption, energy displacement, friction and, in extreme situations, thrust applied via high pressure jets. The high pressure jets can be jets of water incorporated into the system using stand pipes or emergency services pumper vehicles.

Energy absorption in the present invention is achieved by having falling evacuees impact on various flexible structures during the fall and at the termination of the fall. Essentially, energy absorption results from the cushioning effect of temporarily displacing gas in inflated structures, from repeated cushioned contacts and from friction points having flexible strands extending from cushioning pads that absorb additional energy. Those features combine to retard the rate of descent.

The interior structure of the descent tube of the present invention includes energy absorption structures that retard the rate of fall: deflector bulges, inflated padding, deflector ramps, deflector curtains and exit slides. In addition to absorbing energy, the structures translate some of the vertical force to horizontal force as evacuees are temporarily deflected sideways in the descent tube. This is what is meant by energy displacement. The deflector curtains offer enhanced resistance to falling evacuees. Rather than being smooth surfaced, the curtains are serrated with small protrusions having extended friction strands that function to slow passing evacuees. The internal structures interrupt evacuees acceleration and never permit falling evacuees to build up any substantial velocity. That increases the evacuees probability of escaping the emergency unharmed or substantially unharmed.

In situations where the internal structures collapse, an automated fail safe backup system is activated. The backup system includes the use of high pressure water jets that absorb falling evacuee energy.

A second concept included in the present invention is Temporary Structures (TS). Using the present invention does not require a standing structure; rather only a temporary or potential structure is needed. Installation of the present invention, at least when retrofitted to an existing elevator shaft or a new construction, is effectively invisible and does not interfere with normal operations. The present invention is largely composed of synthetic fiber/cloth with no load bearing requirements other than containing evacuees during emergency transit.

A standard installation of the present invention involves interlocking multiple inflatable shapes together. The structures are braced and, in some configurations, counterbraced by the preexisting walls, such as the walls of an elevator shaft, thus providing structural integrity to the invention during the inflation process and providing support during use.

The present evacuation system can be installed as a unified whole or broken down into multiple modules. A unit can extend for the height of one floor or multiple floors. Preferred units of the system extend through four to five floors.

The present system can be designed for single use or for multiple evacuations. The material of the present invention is tear and puncture resistant and remains flexible and strong across a wide temperature range. Certain critical units or sub-assemblies of the present invention can include an emergency back-up system that uses flame resistant solidifying foam in situations involving compromise or damage to the system. The terminus/exit assembly of the present invention, which is positioned on the ground floor, is one such assembly that may be so protected.

A third concept included in the present invention is Energetics (E). Energetics is a relatively old technology in military applications that is just beginning to see use in the civilian arena.

Energetics is essentially a contained chemical reaction, most often combustion similar to a monopropellant rocket, wherein the rapid expansion of gas (exhaust) is used to inflate a structure or to perform some limited work. One such civilian application of Energetics is in automobile airbags. A more common name for an Energetics functional unit is gas bag generator (GBG). The advantages of GBG's include their dependability, their negligible or nonexistent maintenance needs for substantial periods of time, and their almost instantaneous initiation and quick cycle completion performance. GBG's are tailor-built to generate a fixed volume of gas at a predetermined pressure. When the resultant combustion exhaust gas is inert, the advantages in an emergency situation are apparent. GBG's are hard wired into an application and, except for normal safety checks, the GBG's can be forgotten. Since pressure in the present invention is not built up until needed, there is no need to top off the pressure vessels. Other than temporary backup storage units consisting of inflatable bladders, the present invention uses no pressure vessels.

The present system functions by immediate inflation on demand. No power supply is required. Rather, only a solid state ignition with normal control mechanisms and safety systems is needed. Full inflation of the present invention, regardless of size, takes less than 90 seconds. An additional capacity is built into the present system to provide for a limited time continuous inflation in the event of limited damage to the system.

The invention combines several unique features that greatly enhance the safety of evacuees while lowering costs and not obstructing the intended use of existing structures. The present system is uniquely suitable for use with almost any fixed or movable structure including, but not limited to, buildings, ocean platforms, mine shafts and ships. Independent rescue and extraction models of the invention are available for use on structures not equipped with permanent systems before a catastrophe. Further, the system is adaptable to special operational insertions from aircraft in situations where, due to a lack of personnel training or due to a hostile environment, existing evacuation or insertion techniques are inadequate.

These and further and other objects and features of the invention are apparent in the disclosure, which includes the above and ongoing written specification, with the claims and the drawings.

BRIEF DESCRIPTION OF THE DRAWINGS

FIG. 1 shows an embodiment of the present invention having a tube with friction points, bouncing bulges and diverting slopes, and an exit ramp.

FIG. 2 is a cross-sectional view of the tube taken along line 2—2 of FIG. 1, showing a diverting slope extending inward from the inner surface of the tube.

FIG. 3 is a cross-sectional view of the tube taken along line 3—3 of FIG. 1, showing a bouncing bulge extending inward from the inner surface of the tube.

FIG. 4 is a cross-sectional view of the tube taken along line 4—4 of FIG. 1, showing friction points extending inward from the inner surface of the tube.

FIG. 5 shows one embodiment of a segment of a tube having diverting slopes, inflatable cushions and bouncing bulges extending inward from the inner surface of the tube.

FIG. 6 is a cross-section of the tube taken along line 6—6 of FIG. 5.

FIG. 7 is a front elevation of the tube of FIG. 5 showing a diverting slope and inflatable cushions.

FIG. 8 is a cross-sectional side illustration of an embodiment of a diverting slope having valves and friction assistors.

FIG. 9 is an end elevation of the diverting slope of FIG. 8.

FIG. 10 is a detail of a surface of the diverting slope of FIG. 8, showing the friction assistors.

FIG. 11 is a detail of the spring action and energy absorption of the diverting slope.

FIG. 12 is a front elevation of an exit ramp and lower portion of a tube.

FIG. 13 is a side elevation of the exit ramp and tube of FIG. 12.

FIG. 16 shows external window access embodiments of the present invention in a nondeployed configuration and a deployed configuration, respectively.

FIG. 17 is a detail of the external window access embodiment of FIG. 16, showing a sealed coaming adapter.

FIGS. 18*a*, 18*b* and 18*c* show stored, expanding and expanded plan view details of the membrane and heat shields in the external window access embodiment shown in FIGS. 16 and 17.

FIGS. 19*a*, 19*b* and 19*c* are side view details of the external window access embodiment of the present invention in a stored state, a partially activated state and a fully activated state, respectively.

FIGS. 20*a*, 20*b* and 20*c* show plan view details of the external window access embodiment of the present invention in a stored state, a partially activated state and a fully activated state, respectively.

FIG. 21 is a detail of a membrane having pressurizing ribs.

FIGS. 22*a*, 22*b* and 22*c* show an exterior casing that upon activation forms a heat shield.

FIGS. 23*a*, 23*b* and 23*c* are partial plan views of an externally installed embodiment of the present invention in different states of activation.

FIG. 24 is a plan view of a fully deployed, externally-installed segment.

FIG. 25 is a side elevation detail of an activated window access embodiment of the present invention having reinforcement ribs.

FIG. 26 is a cross-sectional detail of the expanded membrane showing a reinforcement rib.

FIG. 27 is a cross-sectional detail of the tube showing the jointed reinforcement ribs locked in place.

FIG. 28 is a cross-sectional detail of the externally-installed segment of the present invention.

FIGS. 29*a*, 29*b*, 29*c* and 29*d* are combined plan and elevation details of the progressive deformation of the diverting slopes of the tube.

FIG. 30 shows an emergency water jet brake system installed around the inner surface of the tube.

FIG. 31 schematically shows an elevator shaft installed embodiment of the present invention having deflector ramps, deflector curtains, bouncing bulges and a rippled exit ramp.

FIG. 32 shows the exit level of an elevator shaft installed embodiment of FIG. 31 prior to activation of the system.

FIG. 33 is a front elevation of the lower end of the tube and the rippled exit ramp of FIG. 31.

FIG. 62 is an instruction panel carrying instructions for using the evacuation system.

FIG. 63 shows the instruction panels of FIG. 62 positioned on walls around the elevator doors.

DETAILED DESCRIPTION OF THE PREFERRED EMBODIMENTS

Figure 14:
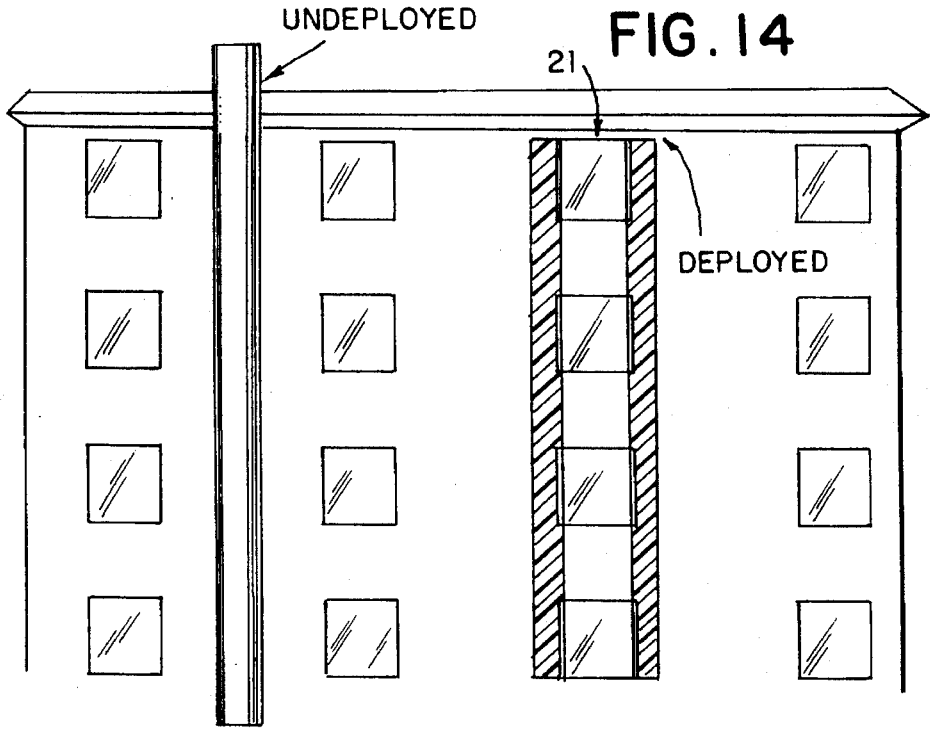
FIG. 14 shows an external installation of the present invention in a nondeployed configuration at left and a deployed configuration at right, respectively.

Referring to FIGS. 1–13, the present invention is a combination of collapsed tubes inflatable by gas generators. When the system is inactive, the tubes remain flat and unnoticed. When activated, the gas generators deliver gas to the tubes, inflating the tubes rapidly. Once inflated, evacuees enter the tube 3 at predetermined entry ports and fall downward through the tube 3. As shown in FIGS. 2–4, friction assistors 5, bouncing bulges 7 and diverting slopes 11 line and extend inward from the inner surface of the tube 3, guiding and slowing bodies as the bodies descend the tube. Evacuees fall safely through the tube 3 and exit the bottom of the tube 3 to safety. The present system is compatible with existing structures. For new constructions, the collapsible tubes 3 can be manufactured in prefabricated building panels, and gas generators can be installed in appropriate locations. The present invention is suitable for external applications as well as internal applications.

In a preferred embodiment, the emergency evacuation system may be provided as an external attachment to structures. The collapsed tube 3 comes in prepackaged segments 13 or modules. One segment 13 is shown in FIG. 5. Each segment 13 of the collapsible tube 3 is connectable to other segments 13 to create a continuous tube 3 of modifiable length. Preferred embodiments of the present invention use segments 13 having lengths ranging from one story to four stories. The segments 13 forming the collapsible tube 3 are attached to a structure, such as a building, by climate and structure appropriate retention points 15. Possible retention points 15 include, but are not limited to, simple bolts, adhesives, pitons and drilled holes filled with solidifying compound. The segments 13 of the tube 3 remain deflated until gas generators are activated. When activated, the generators deliver gas to the segments 13, and the segments 13 expand outward from the structure, forming a continuous tube 3. Preferably, the pressure in the tube 3 is maintained at 30 psi to ensure the structural rigidity of the tube 3 and to prevent blow back from fire. Evacuees enter the tube through predetermined entry ports. An exit ramp 17, as shown in FIGS. 12–13, is positioned at the bottom of the tube 3 to cushion the fall of the evacuee. Padded cushions 9 line the tube 3.

Another preferred embodiment of the present invention, as shown in FIG. 14, has a single entry port 21. As shown in FIG. 14, the entry port 21 is located on the roof, thus giving evacuees an uninterrupted descent through the tube 3 to the ground. That embodiment is inexpensive and is easy to install. Having a single entry port increases the reliability of the system and decreases the likelihood of jams in the system caused by the actions of evacuees or by partial failures of the system. Single entry port 21, however, clearly limits the number of people who can be evacuated. Single point entry also increases evacuation times. A variation of a single point entry embodiment of the present invention positions the entry point at an intermediate point in the length of the tube 3.

Figure 15:
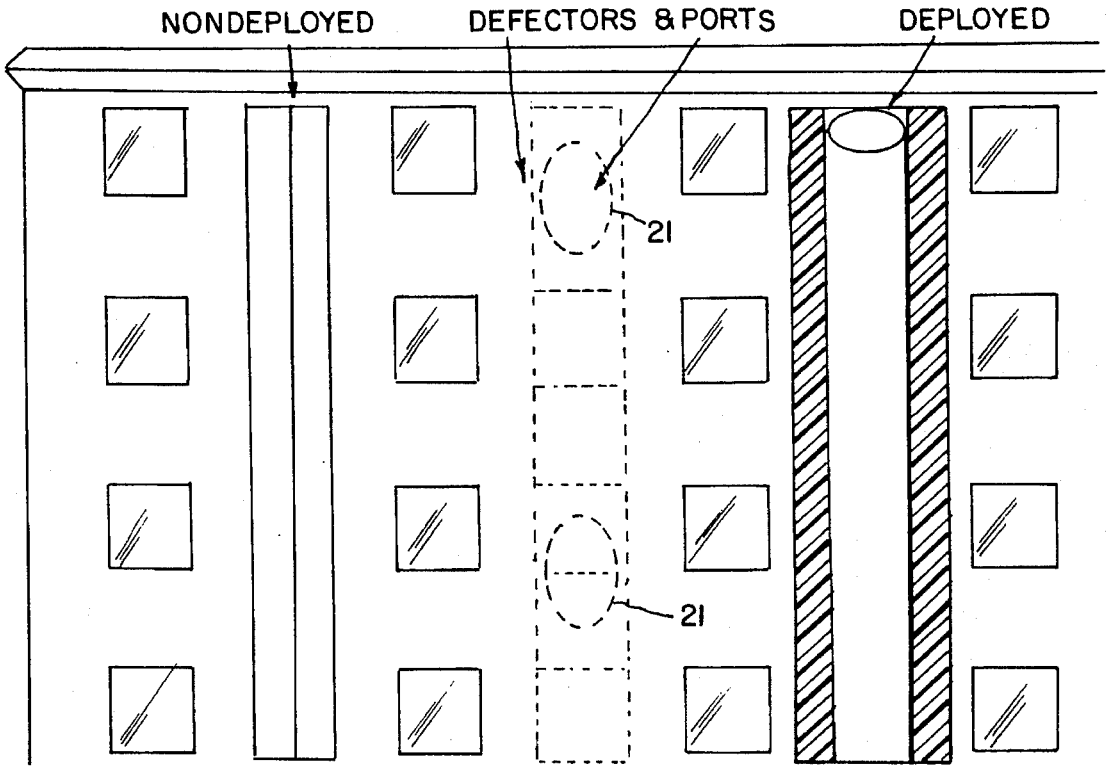
FIG. 15 shows external multi-access port embodiments of the present invention in nondeployed and deployed configurations at left and right and schematically shows entry ports and deflectors in the center.

A second preferred embodiment of the externally attached system has one or multiple entry ports built into the walls of the structure to which the system is attached. FIG. 15 shows an embodiment of the present invention having multiple entry ports 21.

A third preferred external embodiment uses existing window spaces 25 positioned in the walls of the structures as window entry ports 27. FIG. 16 shows that embodiment in nondeployed and deployed configurations. As shown in FIG. 17, a window is removed from a window space 25. A window coaming adapter 29 is positioned around the exterior edges 31 of the window space 25. A tri-ply expanding clear or opaque membrane 33 extends between the sides of the coaming adapter 29 and covers the window space 25. The coaming adapter 29 enables the tube 3 to be continuous, as shown in FIGS. 16 and 17. The window entry embodiment is economical to install, adaptable to most large structures, permits rapid evacuation of persons from all floors, is easily incorporated in new constructions and is easily retrofitted in existing structures.

Preferably, the membrane 33 of the window entry embodiment is tri-ply, as shown in FIGS. 18–21, with expansion cells between the layers to permit independent expansion and thus provide for safety redundancy.

The membrane 33 and adapter 29 are physically continuous with the segments 13 of the tube 3 above and below, as shown in FIGS. 16 and 17. Activation of the upper and lower segments 13 assists in the deployment of the window ports 25. However, the inflation system of the window ports is a segregated unit for safety reasons. A pop-off internal clear shield 35 is locked in place until activation. The shield 35 prevents damage to the membrane 33 due to vandalism or accidents prior to activation. As shown in FIGS. 18–24, once the system is activated, the shield 35 separates in the middle and each arm of the shield 35 swings outward to either side of the window port 25. The arms of the shield 35 can be hinged. The shield 35 effects a pressurized seal that permits expansion of the membrane 33. The shield 35, when separated, becomes a heat shield for protecting the tube 3, thereby extending the time for evacuation. As shown in FIGS. 18 and 20, the present invention can have internal shields 35 and external shields 41. The membrane 33 lies between the internal shield 35 and external shield 41. When activated, the internal shield 35 separates in the middle and opens inward. The external shield 41 also separates in the middle and moves outward as the membrane 33 expands outward. As shown in FIGS. 23 and 24, external stiffeners 43 are positioned on the outer surface of the tube 3 to give the tube structural rigidity.

Additional safety options are available with the window entry port embodiment. In a preferred embodiment, an override lock 42, activatable from remote or proximate locations, is positioned on the shields 35, 41 to prevent the shields from opening. The override lock is designed to deny entry when areas next to the access point are potentially dangerous to users due to the emergency. The lock can be manually operated, such as by the last evacuee to exit a floor, or automatically operated when harmful thermal or noxious gas conditions are sensed.

Preferably, carbon fiber composite ribs 47 are built into the structure of the membrane 33 as shown in FIGS. 25–27. The ribs 47 are located in the central layer 49 of the tri-ply membrane 33. The ribs 47 assist in the expansion of the membrane 33 and provide form and rigidity to the membrane 33 once deployed. The ribs 47 are flexible in the horizontal plane, but are rigid vertically. The ribs 47 are preferably flattened ovoid in cross-section. That cross-sectional shape limits the likelihood of the tube 3 snaring evacuees in cases of partial tube failure. The ribs 47 are vertically linked with reinforced panels to keep evacuees in the tube in cases of partial failure of the expansion cycle or subsequent rupture of the tube 3. The ribs 47 are stored in wall channels in the form of flattened loops. As shown in FIGS. 25–27, when the invention is activated, the ribs 47 are pulled outward by the expanding tube membrane 33. Upon full expansion of the membrane 33, the ribs 47 are locked into place. Locking grooves in the ribs are caught in spring loaded ratchet lock mechanisms. At the outermost point from the structure to which the tube 3 is attached, in the center of each rib 47, is a joint 51, as shown in FIG. 27. The joint 51 of each rib 47 enables the tube 3 to maintain its ovoid cross-section.

All exteriorly installed life step systems share common features. One common feature is an external heat shield 41 formed from the casing of the compressed assembly. When the system is activated, the shield 41 opens outward from the middle. The tube 3 carried in the casing becomes inflated and pushes the walls of the casing further outward. The heat shield 41 provides many advantages including: thermal resistance in fire situations, obstruction of view of the internal area of the tube from vantage points within the evacuated structure (a tremendous advantage in terrorist and criminal evacuations), protection of the tube from wind shear, buffeting and explosion effects, and structural rigidity.

A second common feature of all exteriorly installed embodiments of the present invention is the internal apparatus of the tube 3, referred to as the Progressive Deforming Chute Slide (PDCS). FIGS. 1, 5 and 28 show preferred embodiments of the PDCS. PDCS uses bouncing bulges 7, diverting slopes 11, padded cushions 9 and friction assistors 5, all of which extend from the walls of each segment 13 of the tube 3, to guide and slow falling bodies. The bulges 7, slopes 11, cushions 9 and friction assistors 5 are systematically positioned on the walls of each segment 13. FIG. 5 shows a preferred embodiment of PDCS. The positions of deflector bulges 7 and diverting slopes 11 alternate from the front 55 of the tube 3 to the back 57 of the tube 3 for the entire length of the tube 3. That configuration keeps the descending evacuee in the center zone of the tube 3 and maintains the evacuee in a substantially vertical position, thus reducing the potential for jams and injuries. Friction assistors 5, as shown in FIGS. 8–10, extend from the diverting slopes 11 and the deflector bulges 7. As an evacuee falls through the tube 3, the evacuee impacts on a diverting slope 11. As shown in FIG. 29, the diverting slope 11 deforms and bends downward, thereby absorbing energy through accumulation of tension. The diverting slope 11 essentially forms a sloped saddle, as shown in FIG. 29, and tunnels the evacuee to the next level. The evacuee next contacts a bouncing bulge 7 that absorbs energy and guides the evacuee towards the next diverting slope 11. Once the evacuee disengages a diverting slope 11, the slope 11 rebounds to its original, nondeformed position. As shown in FIG. 5, the walls of the tube 3 can have side deflector cushions 9 to further facilitate a safe evacuation.

Preferably, each diverting slope 11 is designed with a fixed deformation/rebound rate. That ensures that all evacuees descend at reasonably similar rates and prevents evacuees from overtaking others in the tube 3.

Each segment 13 of the tube 3, including the inflatable diverting slopes 11 and bouncing bulges 7 that constitute the internal framework of the segment 13 of the tube 3, is equipped with flapper valves 61, as shown in FIGS. 10 and 11. The flapper valves 61 absorb excess energy from the falling evacuee by releasing air when the evacuee's impact force exceeds safe limits (indicative of excess weight or velocity due to a jam or structural failure, providing a regular feedback in the system). Discharging air prevents damage to the diverting slopes 11 from overload due to failure of preceding upper diverting slopes. Additionally, the discharged air is directed upwards, further reducing the velocity of the evacuee and adding to the overall pressure of the tube 3.

Preferred embodiments of the exteriorly installed embodiment of the present invention have irregular ovoid cross-sections. That configuration enhances deflection of wind and fire hose water streams and minimizes distortion and damage to the tube due to external forces. Additionally, the ovoid shape assists in maintaining the proper orientation of falling evacuees.

A third common feature of all exteriorly installed embodiments of the present invention is an inflatable exit ramp 17, such as an inflatable slide. The slide 17 is positioned at the bottom exit of the tube 3. FIGS. 1, 12–13, 33 and 42 show different embodiments of the slide.

Figure 42:
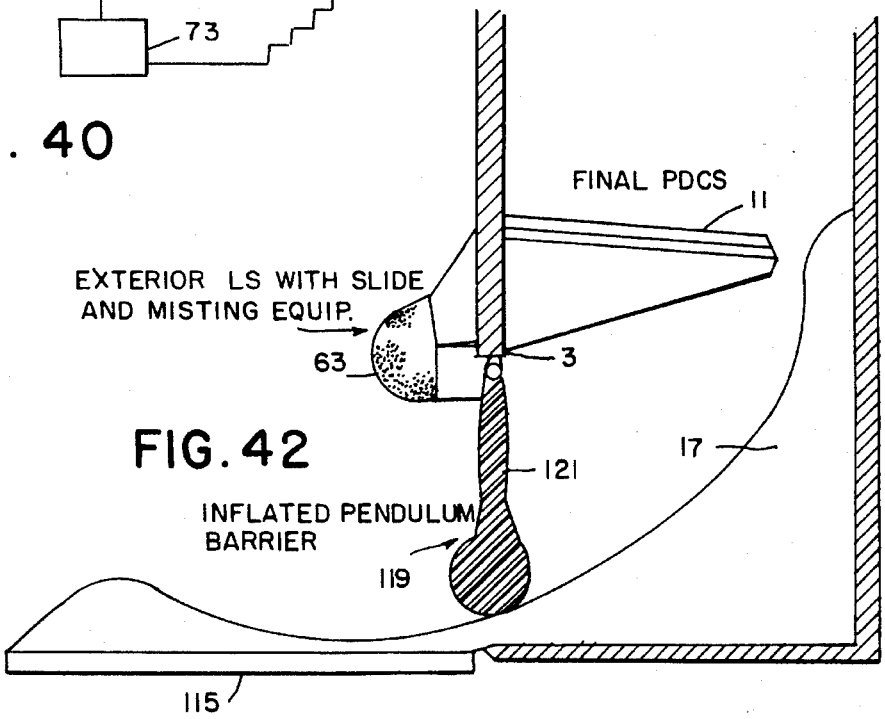
FIG. 42 details an exit terminal of an elevator shaft installed embodiment having a slide, misting equipment, and an inflated pendulum barrier.
Figure 43:
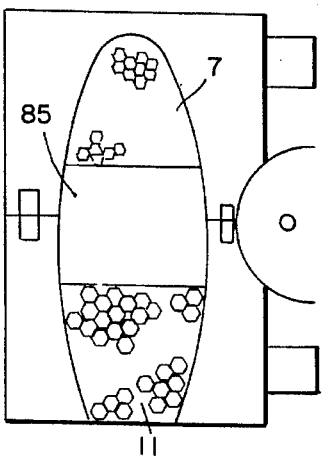
FIG. 43 is a plan view of one descent tube in an elevator shaft installed embodiment.

As shown in FIGS. 30 and 42, external and internal thermal mist installations 63 are easily incorporated in embodiments of the present invention. Those installations 63 are advantageous in reducing thermal danger, in eliminating the presence of toxic gases, and in increasing the time available for evacuation. As shown in FIG. 30, water jets and misting nozzles 65 are positioned in the walls of each segment 13 of the tube 3. The jets or nozzles 65 are connected to the standpipes of the structure to which the present invention is attached. In preferred embodiments, mist installations 63 are automatically turned on when the present invention is activated. In other embodiments, the installations 63 are activated when dangerous toxic gas levels and/or dangerous temperature levels are detected by sensors. The installations 63 may also be manually operated.

Figure 34:
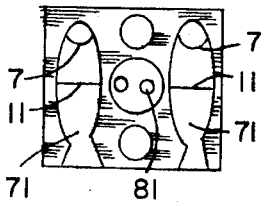
FIG. 34 is a top plan view of the elevator shaft installed embodiment of FIG. 31.

The present invention also has several interior applications. One such interior application is the elevator shaft embodiment shown in FIGS. 31–42. That embodiment has two independent oval descent chutes 71 leading to an exit slide 17. Deflated tube segments are installed in the elevator shaft, preferably at the top of the shaft. When the present invention is activated, either manually or automatically, the elevator 73 is first returned to its lowest point and the passengers in the elevator 73 are evacuated. Once the elevator 73 reaches the lowest point, or parked position, the gas generators are activated, thereby causing inflation of the tube 3. The inflated segments 13 have an extensive internal framework that includes diverting slopes 11, deflector bulges 7 and inflated padding 9, as shown in FIGS. 31, 35–37. In preferred embodiments, the diverting slopes 11 are deflector ramps 77 and deflector curtains 79 extending from the ramps 77. Two independent tubes 3 are created, with one tube on each side of the elevator cable 81, as shown in FIG. 34. FIG. 34 shows an overhead plan view of the present invention installed in an elevator shaft having central cables 81. That design is modifiable for elevator shafts having noncentral cables 81. The shape of the tubes 3 as well as the number of tubes may vary, depending on the elevator shaft design. In all embodiments, however, the cables 81 and other obstructions in the elevator shafts are positioned outside of the inflated tubes 3 to preclude evacuee contact and injury. The entire internal area of the tube 3 is designed to provide no obstructing surface or handholds for evacuees, thus limiting the potential for accidental or deliberate jams in the tube.

Figure 36:
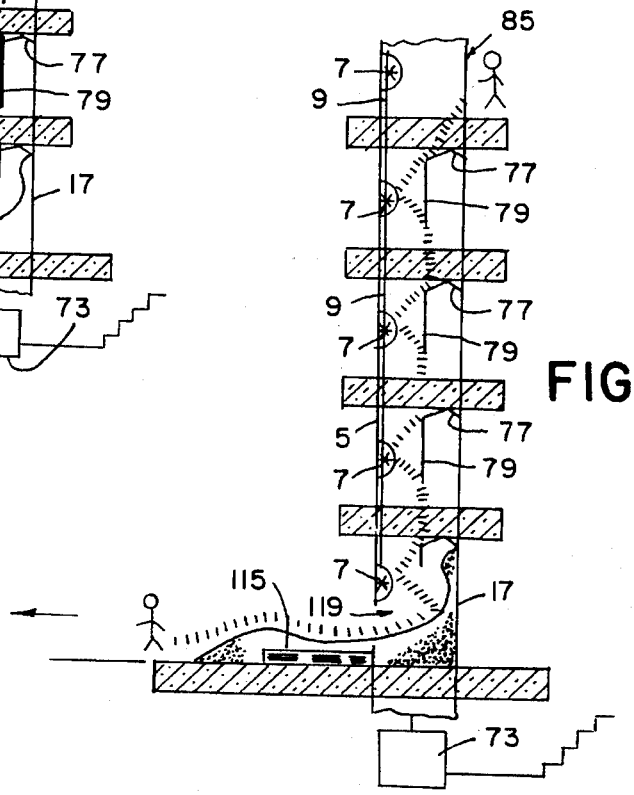
FIG. 36 details the path of evacuees down the embodiment of FIG. 35.
Figure 39:
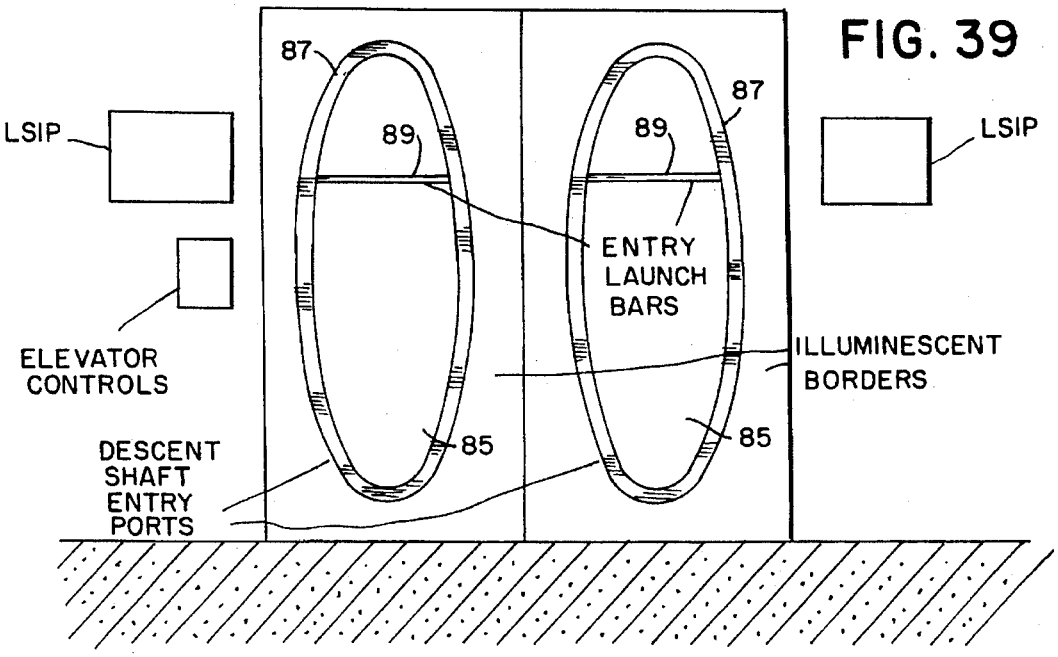
FIG. 39 shows elevator doors equipped with descent entry ports having luminescent borders.

Evacuees enter the tube through entry ports 85 in preexisting elevator doors, as shown in FIG. 39. When the system is activated and the tubes 3 are inflated, the entry ports 85 open. Each floor has entry ports 85 to the tube 3. Entrances to the tube 3 are clearly visible. Luminescent borders 87 can be positioned around the entry ports 85 to assist evacuees in low visibility situations. In preferred embodiments, the ports 85 in the elevator doors open only when temperatures on that floor do not exceed certain lethal levels (limited manual override is possible). Evacuees grasp a horizontal bar 89 that extends across the entry port 85, swing into the tube feet forward, and release the bar 89. FIG. 36 shows the path of an evacuee down one embodiment of the present invention. In the embodiment shown in FIG. 36, all the deflector ramps 77 and curtains 79 are on the side of the tube 3 closest to the entry ports 85. Deflector bulges 7 and padded cushions 9 line the opposite wall of the tube 3. Other embodiments have modified versions of that configuration. Evacuees, upon entry, impact on the deflector ramp 77. As discussed earlier, the deflector ramp 77 is sloped and flexible, thereby absorbing energy of the evacuee. The evacuee next impacts a deflector bulge 7 that absorbs additional energy and directs the evacuee towards the next deflector curtain 79. The deflector curtain 79 absorbs energy and pushes the evacuee down towards the next deflector bulge 7. The process continues until the evacuee reaches the bottom of the tube 3. An inflatable exit ramp 17 is positioned at the exit to the tube 3 to cushion the evacuees fall and direct the evacuee to the safe exit.

Figure 37:
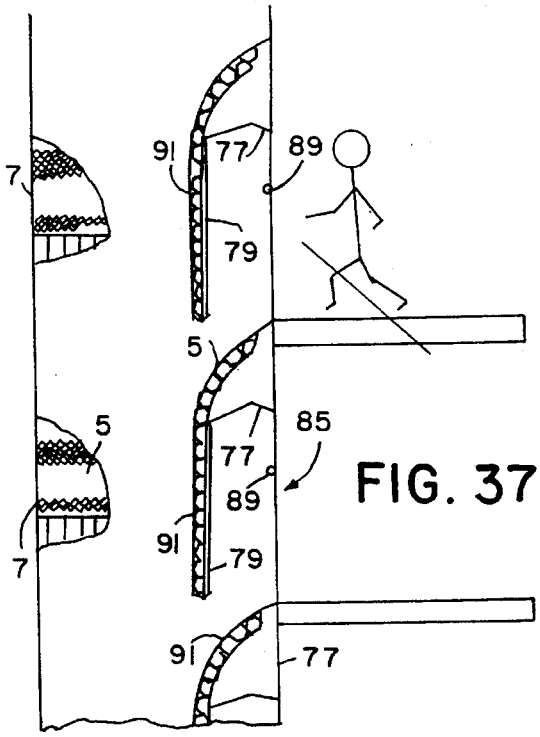
FIG. 37 shows entry of an evacuee to a deployed elevator shaft installed embodiment having bouncing bulges, deflector curtains and deflector ramps.
Figure 38:
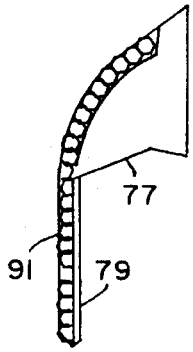
FIG. 38 is a side illustration of a diverting slope having a cushioned deflector curtain connected to a sloped edge of a deflector ramp.

FIGS. 37 and 38 show a preferred embodiment of a diverting slope 11 having a deflector curtain 79 and a deflector ramp 77. The curtain 79 is a honey-combed cushion connected to the front edge of the deflector ramp 77. The diverting slopes 11 are covered with friction assistors 5. Preferably, the diverting slopes 11 are designed with breakaway edges and collapse against the tube wall in situations where the tube is jammed. In preferred embodiments of the present invention, the diverting slopes 11 have noise makers to warn individuals below of subsequent evacuees falling from above.

FIGS. 43–46 show preferred embodiments of the deflector bulge 7. The bulge 7 is nonsnagging, nongrippable and friction-generating. The bulge 7 has an inflated safety core 93 and breakaway cushion quills 95 extending from the core 93.

Figure 45:
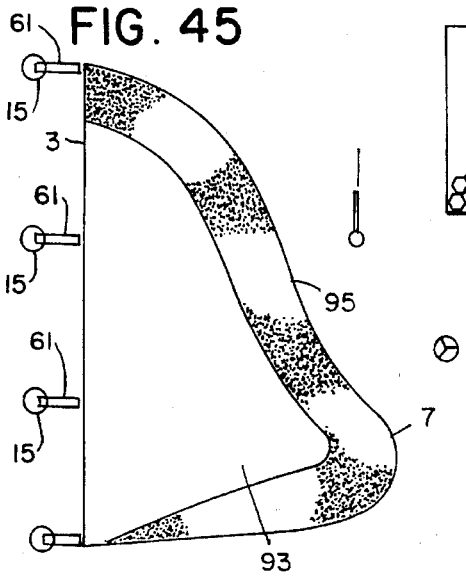
FIG. 45 is a cross-sectional side illustration of a deflector bulge.
Figure 46:
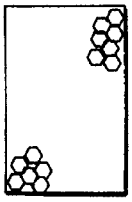
FIG. 46 is a detail of the outer surface of the bulge of FIG. 45.
Figure 47:
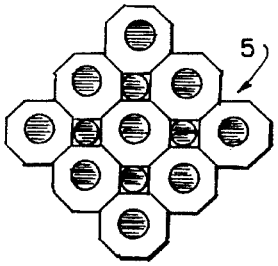
FIG. 47 shows a front view of a friction assistor having nine break away cushion quills.
Figure 48:
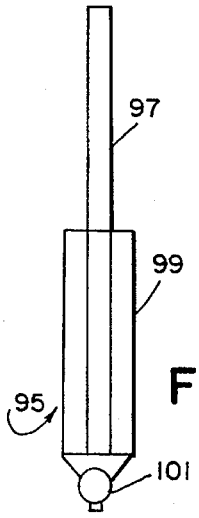
FIG. 48 is a detail of a single break away cushion quill having a friction strand, an inflated cushion and a break away retention and inflation point.

As shown in FIG. 48, each quill 95 has a friction strand 97, an inflated cushion 99, and a break away retention and inflation point 101. Preferably, each friction assistor 5 is made up of nine breakaway cushion quills 95, as shown in FIG. 47. As shown in FIG. 45, one way valves 61 are positioned at the inflation and retention points 15 on the tube 7 to the elevator shaft. The valves 61 allow air to be released as needed during evacuee impact.

Figure 44:
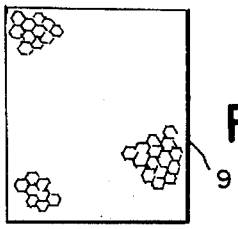
FIG. 44 is a detail of a cushioned side of the descent tube of FIG. 43.

As shown in FIG. 44, the sides of the tube 3 have padded cushions 9.

In preferred embodiments, the entire internal surface of the tube 3 may be covered with friction assistors 5. The friction assistors 5 are variable in size to compensate real time drop.

The elevator shaft embodiment of the present invention has safety redundancies to ensure operability of the system during times of partial failure. If the elevator 73 becomes stalled in the shaft and cannot descend to the parked position at the bottom, only the segments 13 of the tube 3 beneath the elevator 73, along with the exit ramp 17, are inflated. Once the segments 13 are inflated, a safety is tripped, a warning is delivered to the passengers in the elevator 73, and the elevator floor 105 opens, sending the passengers down the tube 3.

Figure 50:
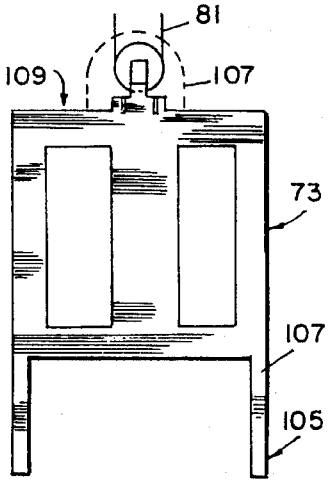
FIG. 50 is a side elevation of the elevator of FIG. 50.
Figure 49:
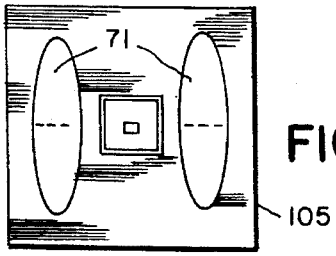
FIG. 49 shows the floor of a retrofitted elevator car that functions as a segment of the tube when the elevator is unable to drop to the bottom of the elevator shaft.

FIGS. 49–50 show the stalled elevator's operation during evacuations using the system. Protective cushions 107 expand around the elevator cables 81, elevator pulley and elevator walls. The opening of the elevator floor 105 activates the inflation of the segments 13 of the tube 3 positioned above the elevator 73. The safeties on the elevator roof doors 109 are released, and the roof doors 109 open, either automatically or when impacted by the first descending evacuee. The elevator 73 thus serves as a segment 13 of the tube 3 and does not obstruct the fall of evacuees.

A second safety redundancy in preferred elevator shaft embodiments is the dual tube design. By having two independent paths of evacuation, failure of one unit does not render the system inactive. Variants are possible to deal with structural differences. Similarly, the segmented structure of each tube enhances the reliability of the system. If one or more segments fail, with or without total combustion on one or more levels (flashover), two or three functioning segments prior to the exit ramp should prove adequate.

Figure 40:
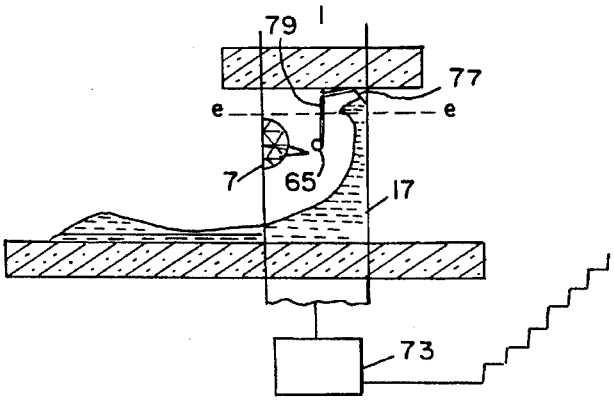
FIG. 40 shows the exit level of an elevator shaft installed embodiment having an exit ramp and fail safe braking jets.
Figure 41:
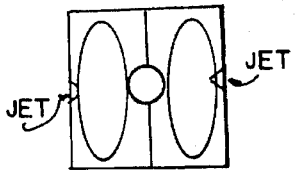
FIG. 41 is a cross-sectional view of the elevators shaft taken along line e—e of FIG. 40.

An additional fail-safe redundancy is shown in FIGS. 40 and 41. A nonobstructive ring of high pressure water nozzles 65 is positioned immediately above the exit ramp 17. The nozzles 65 are linked to remote sensors. When the sensors detect an evacuee falling at an unsafe velocity, the high pressure water nozzles 65 are activated. The jets of water, in conjunction with the exit ramp, serve to break the fall of the evacuee.

Numerous other features can be incorporated in the elevator shaft embodiment of the present system, including low level emergency evacuation lights, audio warnings, and a sprinkler system.

Figure 35:
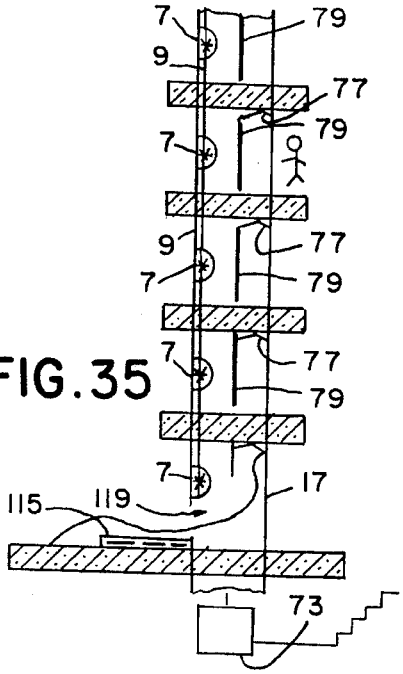
FIG. 35 shows a deployed elevator shaft installed embodiment of the present invention having a drop down wall, a rippled exit slide, deflector curtains, deflector ramps, bouncing bulges and inflated padding.

FIGS. 31, 32 and 42 show preferred embodiments of the exit terminal 17 of the elevator shaft embodiment. Preferably, the exit terminal 17 is designated at the ground floor of a building. The rear wall of the elevator shaft (i.e., the wall opposite the normal elevator exit) is a blow down wall 115. A displacable solid, liquid or gas 117 is disposed behind the blow down wall 115, as shown in FIGS. 31, 35 and 36. Preferably, a crushable inert solid, liquid or gas is positioned behind the wall 115. When the system is activated, the exit ramp 17 inflates, knocking down the blow down wall 115. The exit ramp 17 extends outward through the opening 119 resulting from the break down of the wall and occupies the space previously taken up by the displaced solid, liquid or gas. This precludes injury to persons or damage to property upon activation and creates a fire retardant safe zone. The exit ramp 17 is preferably a rippled ramp, as shown in FIGS. 35 and 36.

FIG. 42 shows a preferred embodiment of the exit ramp 17. The ramp 17 extends outward through the opening 119 left by the blow down wall 115. An inflated pendulum barrier 121 extends downward from the bottom of the tube 3 towards the ramp 17. The pendulum barrier 121 swings outward, allowing evacuees to exit. Misting equipment 63 is also installed as a safety measure. As shown in FIGS. 40 and 41, a terminal braking jet 65 is installed from the end of a diverting slope 11 to reduce the falling velocity of the evacuee. Preferably, the jets 65 are only activated when remote sensors detect a dangerous falling velocity, for example a velocity in excess of 30 feet per second.

Figure 51:
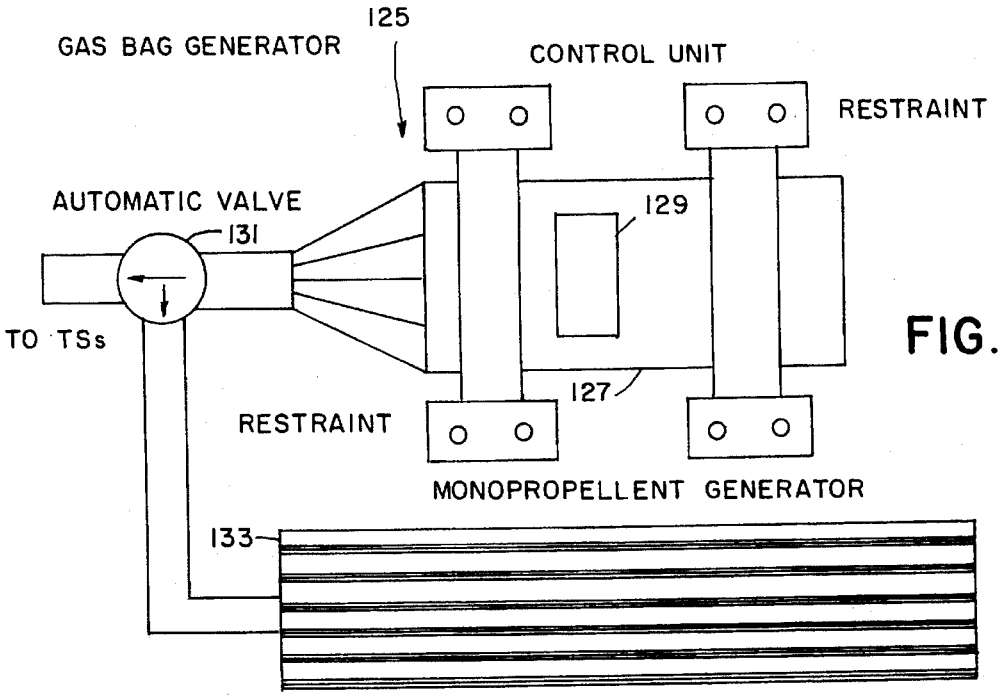
FIG. 51 is a schematic illustration of a generator installation having a monopropellant generator, a control unit, an automatic valve and a temporary expanding pressure storage device.
Figure 52:
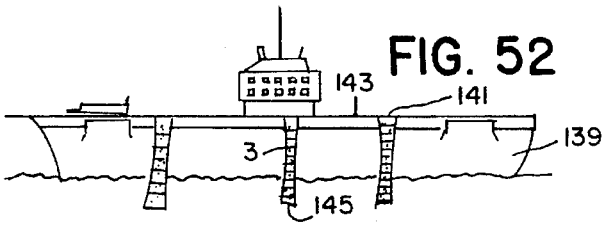
FIG. 52 schematically shows a maritime installed evacuation system.
Figure 53:
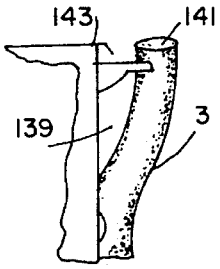
FIG. 53 schematically shows a maritime installed evacuation system viewed from along the side of a vessel.
Figure 53:
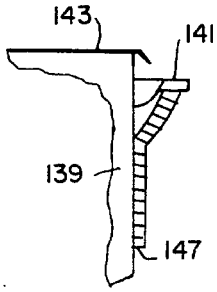
Figure 55:
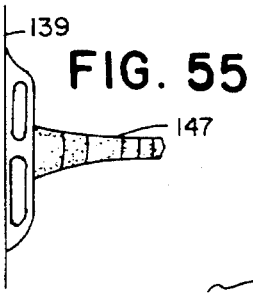
FIG. 55 schematically shows a gas piston extending from the side of a vessel for inflating the tube.
Figure 54:
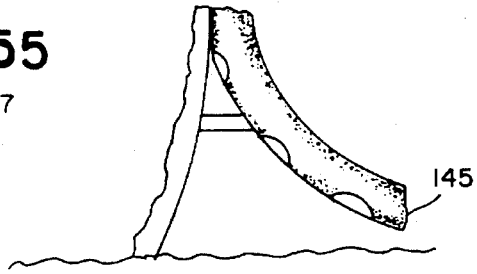
FIG. 54 shows a maritime installation evacuation system extending downward from the deck of a vessel and having a lower segment that arcs away from the side of the vessel.
Figure 56:
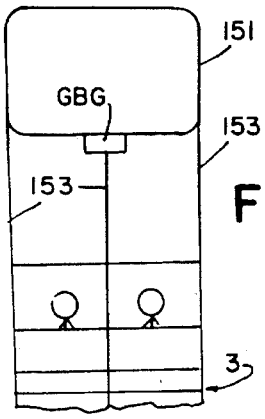
FIG. 56 schematically shows an emergency services evacuation system having a lifting envelope a gas bag generator and guidance steadying cables for lifting a tube up the side of a structure.
Figure 57:
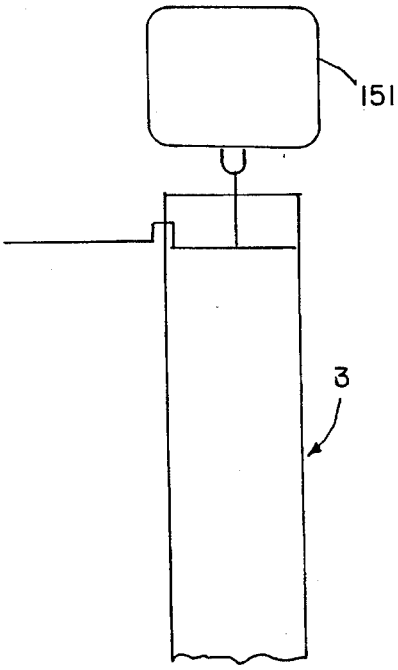
FIG. 57 is a side elevation of the embodiment of FIG. 56.
Figure 58:
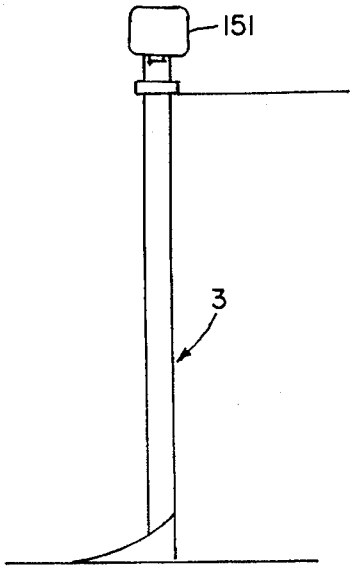
FIG. 58 schematically shows an emergency services evacuation system deployed and temporarily installed on the side of a building.
Figure 59:
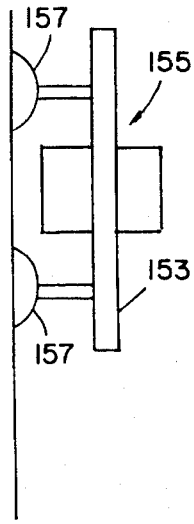
FIG. 59 is a side view of a wall walker unit attached to a wall of a structure.
Figure 61:
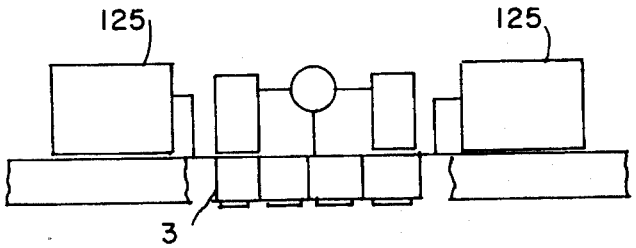
FIG. 61 shows two gas generators positioned at the top of an elevator shaft.

FIGS. 51 and 61 show a typical gas generator installation 125 compatible with all embodiments of the present invention. The generator installation 125 is a gas bag generator that has a monopropellant generator 127, a control unit 129 for controlling the generator 127, an automatic valve 131 that connects the monopropellant generator 127 to the tubes 3, and a temporary expanding pressure device 133 connected to the valve 131. Usually, only one generator installation 125 is needed to activate and maintain the entire system. Backups are usually installed in case of failure. The installations 125, as shown in FIG. 61, can be positioned at the top of the elevator shaft or other structures.

FIGS. 52–55 show another preferred embodiment, a shipborne version, of the present invention. The collapsed tube 3 is connected to the side of a vessel 139. The internal details of the tube 3 are identical to those discussed above. The upper end 141 extends near the deck 143 of the vessel 139. The lower end 145 of the tube 3 is diverted six to twelve meters outward from the side of the vessel 139 to avoid undertow. Evacuees can exit directly into the water or into appropriately modified lifeboats. In preferred embodiments, the lower segments 13 of the tube 3 are selectively inflatable to accommodate exit of evacuees onto platforms of lower vessels and to deflect evacuees beyond the vessel undertow area. In a preferred embodiment, a gas piston 147 extending from the side of the vessel 139 is used to inflate the tube. Guide rails can be used.

As shown in FIGS. 56–60, the present invention can be temporarily installed in emergency situations. In a preferred embodiment, a lifting envelope 151, such as a hot air balloon, carries the tube 3 to the top of a structure. The present invention can also be installed using airplanes, helicopters or any other vehicle capable of upward and downward movement. Guide steadying cables 153 extend downward from the lifting envelope 151. One or more tubes 3 expand along the cables 153 as the lifting envelope 151 rises.

Figure 60:
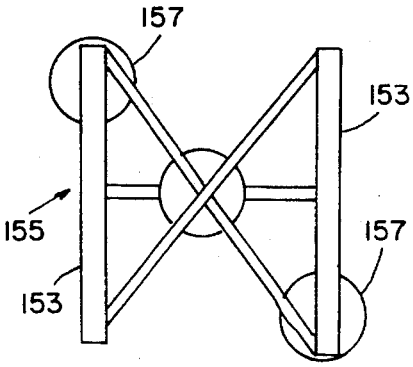
FIG. 60 is a front view of the wall walker unit of FIG. 58.

In preferred embodiments, as shown in FIG. 60, a wall walker unit 155 is used as the primary transient stabilizer for the tube 3. Preferably, a wall walker unit 155 is used to direct the rate of and direction of the envelope 151 and attached tube 3. The unit 155 is best suited for use on structures having smooth surfaces or buildings fitted with smooth wall walker unit strips. The unit 155 has vertical guide rails 153. A movable suction pad 157 is positioned on each guide rail 153. A first suction pad is always attached to the wall of the structure while a second suction pad is extended up or down the length of the guide rail 153 until the moving pad is activated. The first suction pad is then released and the cycle repeats itself. The unit provides for a steady upward lift of the lifting envelope 151 and permits a creeping of the tube 3 up the side of a building. Since the suction pads 157 can be moved perpendicularly away or towards the building surface, obstacles are avoidable. The unit can be preprogrammed or remotely controlled.

Using the present invention is simple and safe. When the gas generators are activated, audio and visual directions are initiated. The evacuees are directed to assemble at each floor's descent entry port. When no entry port is installed on a floor, evacuees are guided to the next closest entry port. Each entry port only permits the passage of a single person at a time per tube. That reduces the possibility of panic jamming. One by one, evacuees grasp the entry bar and swing forward. If no bar is present, or if the evacuee is afraid, the evacuee can lower himself down the tube. The evacuee immediately encounters a diverting slope. The slope is flexible and absorbs some of the energy of the launch. Once on the slope, the evacuee is committed to descent. As the slope flexes, a warning signal, such as a rattle, is initiated, thereby warning evacuees immediately below not to release their grip and enter the shaft at that time. In more advanced embodiments of the present invention, the evacuee, once entering the tube, is showered in a cooling water mist to reduce dangers of heat and toxic gases. From the diverting slope, the evacuee is directed to a deflector bulge. The evacuee's impact with the deflector bulge absorbs additional acceleration energy and directs the evacuee downward. The evacuee next impacts a lower diverting slope. When the diverting slope is a deflector ramp and/or deflector curtain, the evacuee impacts against the deflector curtain. The evacuee's impact with the diverting slope or deflector curtain again absorbs more acceleration energy and directs the evacuee down to the next director bulge. Contact with the diverting slope or deflector curtain also serves to preclude jamming of the shaft, as the impact temporarily moves the slope or curtain backwards, thereby obstructing the entry port at that level and preventing two people from trying to occupy the same place in the shaft at the same time. The cycle is repeated all the way down the tube. In preferred embodiments, the deflector bulges and diverting slopes are positioned to slow an evacuee's fall to a rate of 15 to 23 feet per second, or roughly a floor per second. On reaching the final deflector bulge or diverting slope, the evacuee is deflected horizontally across the tube onto an exit ramp. The evacuee then slides down the ramp and exits to safety.

In preferred embodiments of the present invention, any evacuee entering the final segment of the tube at a high velocity (i.e., in excess of 30 feet/second) is detected by sensors that trigger emergency restraint jets. The jets absorb the excess acceleration energy of the evacuee.

As an additional safety precaution, the deflector bulges 7 and diverting slopes 11 are designed to break away when excess strain is applied. That feature prevents jams, as the weight of an evacuee caught up on a slope or bulge will cause the slope or bulge to pull away and separate from the wall of the tube, allowing the descent to continue.

The present invention is simple and easy to use. Operational instruction panels 161, for example as shown in FIG. 62, are posted in convenient locations such as walls near elevator doors, as shown in FIG. 63. To facilitate public introduction and acceptance of the present invention, embodiments of the system can be constructed as entertainment attractions in theme parks, with appropriate audiovisual enhancements and longer drops.

The features of the different embodiments discussed above are interchangeable.

While the invention has been described with reference to specific embodiments, modifications and variations of the invention may be constructed without departing from the scope of the invention, which is defined in the following claims.

I claim:

1. An emergency evacuation system comprising an inflatable tube having an inner surface, an outer surface, a top end and an open bottom end, an inflatable exit slide positioned at the open bottom end of the tube, a gas generator connected to the tube and the exit slide for inflating the tube and the slide to an optimum pressure, and plural connectors positioned on the tube for connecting the tube to a structure, at least one entry port leading into the tube, and multiple inflatable structures extending inward from the inner surface of the tube.

2. The system of claim 1, wherein the tube comprises multiple tubular segments connected to each other to form a continuous descent tube.

3. The system of claim 1, wherein the connectors are selected from the group consisting of bolts, adhesives, pitons and drilled holes filled with solidifying compounds.

4. The system of claim 1, wherein the optimum pressure is 30 psi.

5. The system of claim 1, wherein the structure is a building and the tube is connected to an external side of the building, and wherein the at least one entry port is positioned on a roof of the building.

6. The system of claim 1, wherein the structure is a building and the tube is connected to an external side of the building, the side of the building having exits, and wherein the tube has multiple entry ports positioned at the exits of the side of the building.

7. The system of claim 1, wherein the tube is connected to an external side of a building having window spaces with exterior edges, and wherein the tube has entry ports positioned at the window spaces, each entry port further comprising a window coaming adapter positioned around the exterior edges of the window space and a membrane carried by and extending between sides of the adapter, and wherein the membrane expands with the tube as the tube is inflated.

8. The apparatus of claim 7, wherein the membrane is a three layer expanding membrane having an outer layer, an inner layer and a middle layer, and having expansion cells between the three layers of the membrane to permit independent expansion of the layers.

9. The apparatus of claim 7, wherein the membrane comprises multiple layers and having expansion cells between adjacent layers for allowing independent expansion of layers.

10. The apparatus of claim 7, wherein each entry port of the tube has a first shield positioned behind the membrane and connected to the structure for protecting the membrane, the shield having a first arm and a second arm, the arms lying in a straight line when the tube is inactivated and separating and swinging outward from each other when the tube is activated.

11. The apparatus of claim 10, further comprising a second shield extending between edges of the window space such that the membrane is sandwiched between the first shield and the second shield.

12. The apparatus of claim 10, further comprising an override lock positioned on the first shield to prevent the first shield from opening automatically.

13. The system of claim 7, further comprising ribs positioned in the middle layer of the membrane to assist in expansion of the membrane and to provide form and rigidity to the membrane once the system is deployed, and wherein the ribs are flexible in a horizontal plane and rigid in a vertical plane.

14. The system of claim 13, further comprising reinforced panels connected to the ribs for vertically linking the ribs.

15. The system of claim 13, further comprising wall channels positioned in the window space for holding the membrane and the ribs.

16. The system of claim 13, further comprising spring loaded ratchet lock mechanisms positioned near the ribs, and wherein each rib has a joint at a center of the rib and a locking groove for catching the spring loaded ratchet lock mechanisms.

17. The system of claim 13, wherein the tube, membrane and ribs have ovoid cross-sections when fully inflated.

18. The system of claim 1, wherein the inflatable structures extend inward from the inner surface of the tube and are positioned such that descending evacuees remain along a central region of the tube and for reducing velocities of the descending evacuees, further wherein the inflatable structures include bouncing bulges, diverting slopes and padded cushions, and wherein surfaces of the bouncing bulges, diverting slopes and padded cushions have friction assistors.

19. The system of claim 18, wherein the configuration has a first side of the tube having diverting slopes, a second side of the tube which is opposite the first side having bouncing bulges, and cushions extending along sides of the tube between the bouncing bulges and diverting slopes.

20. The system of claim 18, wherein diverting slopes and bouncing bulges alternate from a front wall of the tube to a back wall of the tube for the entire length of the tube.

21. The system of claim 18, further comprising flapper valves positioned on the inflatable structures for absorbing excess energy of descending evacuees and for discharging air from the structures.

22. The system of claim 18, wherein the diverting slope has a deflector ramp connected to the tube and a deflector curtain extending from the deflector ramp.

23. The system of claim 1, further comprising plural misting installations positioned in the tube.

24. The system of claim 1, further comprising plural high pressure water nozzles positioned all around the inner surface of the tube at intervals for delivering jets of water to a central region of the tube for slowing a descending evacuee.

25. An emergency evacuation system for an elevator shaft comprising at least one inflatable tube having an inner surface, an outer surface, a top end and a bottom end, an inflatable exit slide positioned at the open bottom end of the tube, a gas generator connected to the tube and the exit slide for inflating the tube and the slide to an optimum pressure, at least one entry port leading into the tube, and multiple inflatable structures extending inward from the inner surface of the tube.

26. The system of claim 25, wherein the tube has entry ports positioned at plural elevator entrances on each floor of the building, and wherein multiple elevator cables positioned in the elevator shaft are excluded from the tube.

27. The system of claim 25, further comprising a second tube connected to the elevator shaft.

28. The system of claim 25, further comprising a release bar extending from the tube at the entry port to facilitate entry into the inflated tube.

29. The system of claim 25, further comprising an elevator connected to the elevator cables, and wherein the elevator has an opening floor, an opening roof, inflatable padding and plural safeties positioned on the roof and the floor for preventing the roof and the floor from inadvertently opening.

30. The system of claim 25, further comprising a ring of high pressure water nozzles connected to the bottom of the tube above the exit ramp, and sensors connected to the ring and positioned in the tube above the ring for sensing velocities of evacuees, and wherein the nozzles deliver high pressure streams of water into a central region of the tube when the sensors detect high velocities.

31. The system of claim 18, wherein the bouncing bulges are connected to the inner surface of the tube and have an inflated safety core and friction points extending from the core.

32. The system of claim 1, wherein the friction assistors have multiple breakaway cushion quills, and wherein each cushion quill further comprises a friction strand, an inflated cushion connected to the strand, and a breakaway retention and inflation point connected to the inflated cushion.

33. The system of claim 1, wherein the exit ramp is an inflatable exit ramp having a rippled surface.

34. The system of claim 1, further comprising an inflated pendulum barrier extending from the bottom end of the tube toward the exit ramp.

35. The system of claim 1, wherein the gas generator has a monopropellant generator, a control unit connected to the monopropellant generator for controlling the generator, an automatic valve connected to the monopropellant generator and to the tube, and a temporary expanding pressure device connected to the automatic valve.

36. The system of claim 18, wherein the inflatable structures are removably attached to the inner surface of the tube.

37. An emergency evacuation system comprising an inflatable tube having an inner surface, an outer surface, a top end and an open bottom end, an inflatable exit slide positioned at the open bottom end of the tube, a gas generator connected to the tube and the exit slide for inflating the tube and the slide to an optimum pressure, and plural connectors positioned on the tube for connecting the tube to a structure, at least one entry port leading into the tube, and multiple inflatable structures extending inward from the inner surface of the tube, and further comprising a wall walker unit for carrying the tube up a side of the structure, the wall walker unit further comprising vertical guide rails and multiple suction pads connected to the rails and capable of being moved up, down, towards and away from the side of the structure.

38. An emergency evacuation system for use in elevator shafts comprising a gas generator positioned at a top of an elevator shaft, a first tube having a top end, a bottom end, an inner surface and an outer surface, a second tube having a second top end, a second bottom end, a second inner surface and a second outer surface, the first tube and the second tube positioned next to each other such that elevator cables of the elevator shaft are positioned between the outer surfaces of the tubes, and wherein the tubes are connected to walls of the elevator shaft and extend along an entire length of the elevator shaft, an inflatable exit ramp positioned beneath the bottom ends of the tubes, a blow out wall positioned in the elevator shaft on a level where the exit ramp is located for being toppled as the exit ramp expands and exerts pressure on the blow out wall, and inflatable structures extending inward from the inner surfaces of the tubes for directing evacuees down the tube and for reducing velocities of evacuees.

39. A method for evacuating structures comprising the steps of installing a tube, activating gas generators, inflating a tube and internal structures connected to the tube and exit ramps with gas delivered from the activated gas generators, entering the tube through an entry port in the tube, descending down the tube, systematically impacting the internal structures extending inward from an inner surface of the tube, exiting the tube, sliding down the exit ramp, and exiting to safety.

40. The method of claim 39, wherein installing the tube includes installing the tube at a top of an elevator shaft, and further comprising directing an elevator to a bottom of the elevator shaft prior to inflating the tube.

41. The method of claim 40, further comprising knocking down a blow out wall positioned in the elevator shaft on a level where the exit ramp is located.

42. The method of claim 39, wherein entering the tube comprises grabbing an entry bar extending across the entry port.

43. The method of claim 39, further comprising activating plural mist installations positioned in the tube and near the exit ramp.

* * * * *